US007609590B2

(12) United States Patent
Irie

(10) Patent No.: US 7,609,590 B2
(45) Date of Patent: Oct. 27, 2009

(54) RECEIVING DEVICE, RADIO CLOCK, AND RECEIVING METHOD

(75) Inventor: Michio Irie, Suwa (JP)

(73) Assignee: Seiko Epson Corporation, Shinjuku-ku, Tokyo (JP)

( * ) Notice: Subject to any disclaimer, the term of this patent is extended or adjusted under 35 U.S.C. 154(b) by 0 days.

(21) Appl. No.: 12/182,042

(22) Filed: Jul. 29, 2008

(65) Prior Publication Data

US 2009/0040876 A1 Feb. 12, 2009

(30) Foreign Application Priority Data

Aug. 8, 2007 (JP) ..... 2007-206208

(51) Int. Cl.
*G04C 11/02* (2006.01)
*H01Q 1/12* (2006.01)

(52) U.S. Cl. ..... 368/47; 343/718; 343/720

(58) Field of Classification Search ..... 368/10, 368/11, 46, 47; 343/718, 720
See application file for complete search history.

(56) References Cited

U.S. PATENT DOCUMENTS 5,144,599 A * 9/1992 Blaich et al. ..... 368/10
5,253,226 A * 10/1993 Ganter ..... 368/47
6,134,188 A * 10/2000 Ganter et al. ..... 368/47
7,280,438 B2 * 10/2007 Fujisawa ..... 368/47
2004/0155818 A1 * 8/2004 Barras et al. ..... 343/700 MS

FOREIGN PATENT DOCUMENTS

JP 5-37409 2/1993
JP 2000-321383 A 11/2000
JP 2006-140659 A 6/2006
WO WO 2005/057726 6/2005

* cited by examiner

*Primary Examiner*—Vit W Miska
(74) *Attorney, Agent, or Firm*—Townsend and Townsend and Crew, LLP

(57) ABSTRACT

A receiving device includes: an antenna to which a communication signal containing time information is inputted; a ground allowing the antenna to function; a conductive part; a gain characteristics change unit which interrupts continuity between the ground and the conductive part to change the gain characteristics of the antenna; a receiving unit which obtains the time information from the communication signal inputted to the antenna; and a control unit which commands the gain characteristics change unit to interrupt the continuity and commands the receiving unit to obtain the time information. When the time information cannot be obtained from the communication signal inputted to the antenna having a certain type of gain characteristics, the control unit commands the gain characteristics change unit to interrupt the continuity and commands the receiving unit to obtain the time information from the communication signal inputted to the antenna whose gain characteristics have been changed.

20 Claims, 6 Drawing Sheets

NOT CONNECTED WITH GND

CONNECTED WITH GND

RECEIVING DEVICE, RADIO CLOCK, AND RECEIVING METHOD

CROSS-REFERENCES TO RELATED APPLICATIONS

This application claims priority to Japanese Patent Application No. 2007-206208, filed Aug. 8, 2007, whose teachings are incorporated herein by reference.

BACKGROUND

1. Technical Field

The present invention relates to a receiving device, a radio clock, and a receiving method for receiving communication signals containing time information.

2. Related Art

A radio clock which displays accurate time information by receiving time signals transmitted on radio waves is designed to receive standard radio waves in a long wave band transmitted from a ground base station, or time signals in an extremely short wave band transmitted from a GPS (global positioning system) satellite. Also, a radio clock proposed in recent years as in JP-A-2000-321383 receives time signals contained in radio waves in an extremely short wave band modulated by CDMA (code division multiple access) before transmission and obtains accurate time for the purpose of mobile communication. Since waves in the extremely short wave band are relayed by various base stations, plural types of waves can be simultaneously transmitted. Thus, these waves are known as waves receivable in a more preferable condition in various receiving places such as inside of buildings and underground compared with standard waves in a long wave band and waves from the GPS satellite. However, the electric field intensity of the waves containing time signals and transmitted from the base station is high when these waves are received in the vicinity of the base station. In this case, distortion of the receiving signals is caused due to saturation of an amplifier included in the wave clock. A radio clock disclosed in JP-A-5-37409 prevents this distortion and improves receiving capability by disposing an attenuator and a select switch between an antenna and an amplifier of a mobile communication device. According to this radio clock, the attenuator operates when the electric field intensity of the waves is high, and stops when the electric field intensity is low for reception of radio waves from the base station.

According to the mobile communication device shown in the above reference, the attenuator and the select switch are disposed on the first part of the mobile communication device, that is, on the route of the inputted signals. In this case, insertion loss of the select switch is produced, and adverse effects such as decrease in the impedance matching and mixing of noise are caused depending on the layout of the attenuator and select switch and the length of the wires. As a result, receiving quality is lowered. Moreover, the necessity for providing the attenuator appropriate for high frequency inside the mobile communication device increases the manufacturing cost and size of the mobile communication device.

SUMMARY

It is an advantage of the invention to provide a receiving device, a radio clock, and a receiving method capable of solving at least a part of the problems described above.

A receiving device includes according to a first aspect of the invention includes: an antenna to which a communication signal containing time information is inputted; a ground allowing the antenna to function; a conductive part; a gain characteristics change unit which interrupts continuity between the ground and the conductive part to change the gain characteristics of the antenna; a receiving unit which obtains the time information from the communication signal inputted to the antenna; and a control unit which commands the gain characteristics change unit to interrupt the continuity and commands the receiving unit to obtain the time information. When the time information cannot be obtained from the communication signal inputted to the antenna having a certain type of gain characteristics, the control unit commands the gain characteristics change unit to interrupt the continuity and commands the receiving unit to obtain the time information from the communication signal inputted to the antenna whose gain characteristics have been changed.

According to this structure, when the time information cannot be obtained from the communication signal inputted to the antenna having the certain type of gain characteristics, the control unit commands the gain characteristics change unit to interrupt the continuity between the ground and the conductive part for changing the certain type of gain characteristics of the antenna, and commands the receiving unit to obtain the time information from the communication signal inputted to the antenna whose gain characteristics have been changed. In this case, the gain characteristics of the antenna can be changed by interruption of the continuity between the ground and the conductive part without the need for providing an electronic component such as attenuator and select switch for changing the gain characteristics disposed on the route of the input signal. Thus, adverse effects such as insertion loss of the select switch, decrease in the impedance matching caused by layout of the attenuator and select switch or the length of the wires, and mixing of noise can be prevented. Accordingly, the receiving capability can be improved without decrease in the receiving quality. Moreover, the size and manufacturing cost of the receiving device can be reduced by eliminating the need for providing the attenuator.

It is preferable that the gain characteristics change unit has a switch which interrupts the continuity between the ground and the conductive part, and that the antenna has higher gain characteristics when the switch is under the non-conductive condition than those when the switch is under the conductive condition.

According to this structure, the antenna has higher gain characteristics when the switch is under the non-conductive condition. Thus, the effect of insertion loss of the switch can be further reduced.

It is preferable to further include an electric field intensity measuring unit which measures electric field intensity of the communication signal. In this case, it is preferable that the control unit commands the gain characteristics change unit to interrupt the continuity by referring to the measured electric field intensity.

According to this structure, the gain characteristics can be varied according to the measured electric field intensity.

It is preferable that the control unit commands interruption of the continuity to decrease the gain characteristics of the antenna when the time information cannot be obtained from the communication signal inputted to the antenna having the certain type of gain characteristics under the condition where the measured electric field intensity is higher than a predetermined reference value.

According to this structure, the gain characteristics of the antenna are decreased when the measured electric field intensity is higher than the predetermined reference value. Thus, distortion of the receiving signal caused by saturation of the amplifier can be removed.

It is preferable that the gain characteristics change unit interrupts the continuity by using a switching diode.

It is preferable that the gain characteristics change unit changes the gain characteristics of the antenna by switching the position of continuity with the conductive portion.

A radio clock according to a second aspect of the invention includes the receiving device described above. According to this structure, the radio clock which is compact and capable of achieving reduction of size, power consumption, and manufacturing cost can be provided.

It is preferable that the conductive portion of the radio clock is an external component including a metal case.

According to this structure, the external component including the metal case of the radio clock is used as a conductive portion for changing the gain of the antenna. In this case, the gain characteristics are efficiently changed. Moreover, in the structure utilizing the external component of the radio clock as the conductive portion, a component functioning as the conductive portion need not be added. Thus, the manufacturing cost and labor of the radio clock can be reduced.

A receiving method according to a third aspect of the invention includes: a first step which inputs a communication signal containing time information to an antenna; a second step which obtains the time information from the communication signal inputted to the antenna; and a third step which changes a certain type of gain characteristics of the antenna by interrupting continuity between a ground for allowing the antenna to function and a conductive portion and obtains the time information from the communication signal inputted to the antenna whose gain characteristics have been changed when the time information cannot be obtained from the communication signal inputted to the antenna having the certain gain characteristics in the second step.

According to this structure, the third step commands the gain characteristics change unit to interrupt the continuity between the ground and the conductive part for changing the certain type of gain characteristics of the antenna, and commands the receiving unit to obtain the time information from the communication signal inputted to the antenna whose gain characteristics have been changed when the time information cannot be obtained from the communication signal inputted to the antenna having the certain type of gain characteristics. In this case, the gain characteristics of the antenna can be changed by interruption of the continuity between the ground and the conductive part without the need for providing an electronic component such as an attenuator and a select switch for changing the gain characteristics disposed on the route of the input signal. Thus, adverse effects such as insertion loss of the select switch, decrease in the impedance matching caused by layout of the attenuator and select switch or the length of the wires, and mixing of noise can be prevented. Accordingly, the receiving capability can be improved without decrease in the receiving quality. Moreover, the size and manufacturing cost of the receiving device can be reduced by eliminating the need for providing the attenuator.

BRIEF DESCRIPTION OF THE DRAWINGS

The invention will be described with reference to the accompanying drawings, wherein like numbers reference like elements.

DESCRIPTION OF EXEMPLARY EMBODIMENTS

Examples of a radio clock as a receiving device according to an embodiment of the invention are herein described with reference to the drawings.

First Embodiment

Figure 1:
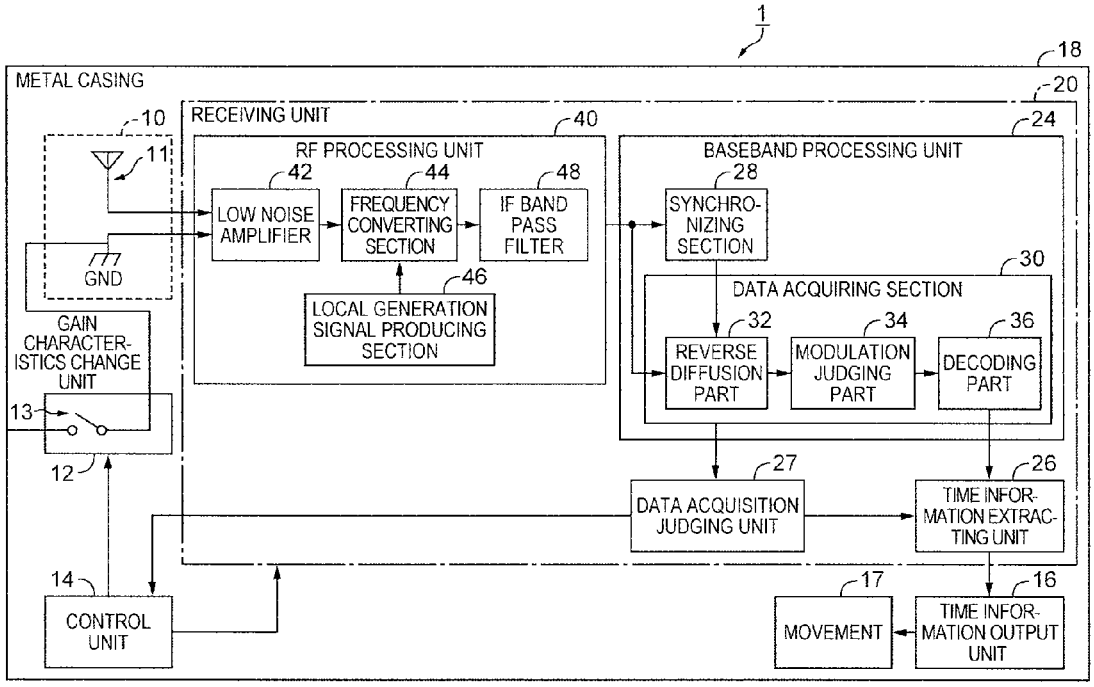
FIG. 1 is a block diagram showing a structure of a radio clock according to a first embodiment.
Figure 2:
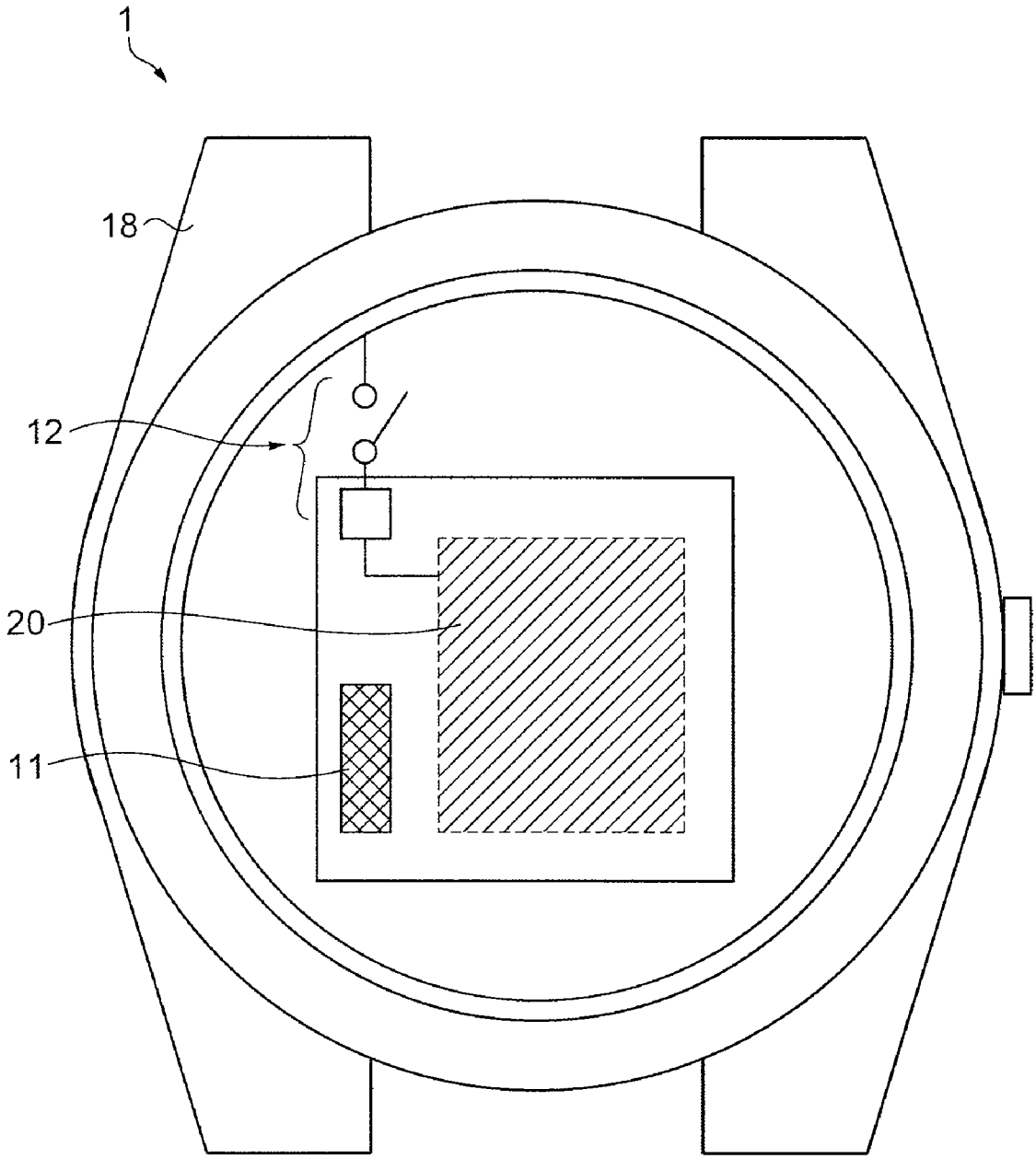
FIG. 2 is a plan view of a part of the interior of the radio clock.

FIG. 1 is a block diagram showing a structure of a radio clock 1 according to a first embodiment. FIG. 2 is a plan view illustrating a part of the interior of the radio clock 1. The radio clock 1 includes a receiving device which obtains standard time information contained in radio waves in an extremely short wave band transmitted after CDMA modulation, and displays accurate time corrected based on the standard time. More specifically, the radio clock 1 includes an antenna unit 10, a gain characteristics change unit 12, a control unit 14, a receiving unit 20, a time information output unit 16, a movement 17, and a metal casing 18. In these components, the antenna unit 10, the gain characteristics change unit 12, the control unit 14, the receiving unit 20, and the time information output unit 16 constitute the receiving device. According to the first embodiment, the radio clock 1 is a wristwatch shown in FIG. 2, and the metal casing 18 is an external metal case of the wristwatch. However, the metal casing 18 is not limited to the external metal case, but may be any metal component constituting the wristwatch.

The antenna unit 10 has an antenna 11 and a ground GND allowing the antenna 11 to function, and receives communication signals in which standard time information is converted by CDMA modulation and transmitted on radio waves from a base station. In the first embodiment, the antenna 11 is a chip antenna which uses a metal component shown in FIG. 2. In the normal condition, the antenna 11 uses the metal component such as the GND part on a substrate on which the antenna 11 is mounted as a pseudo ground. The antenna 11 is not limited to the chip antenna, but may be any type of antenna.

Figure 3A:
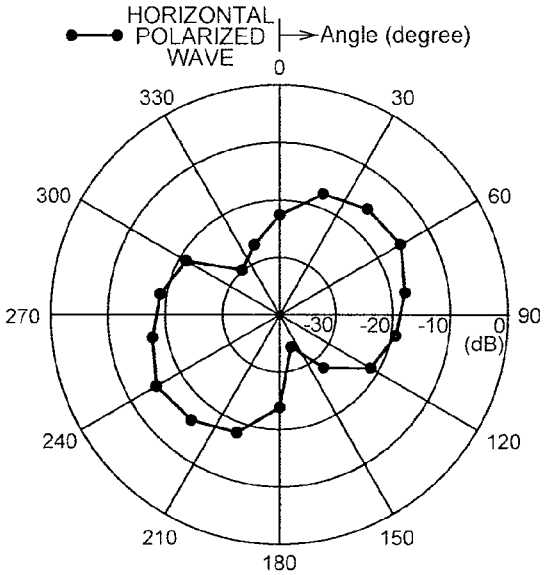
FIG. 3A shows gain characteristics when a ground of an antenna unit and a metal casing are not connected.
Figure 3B:
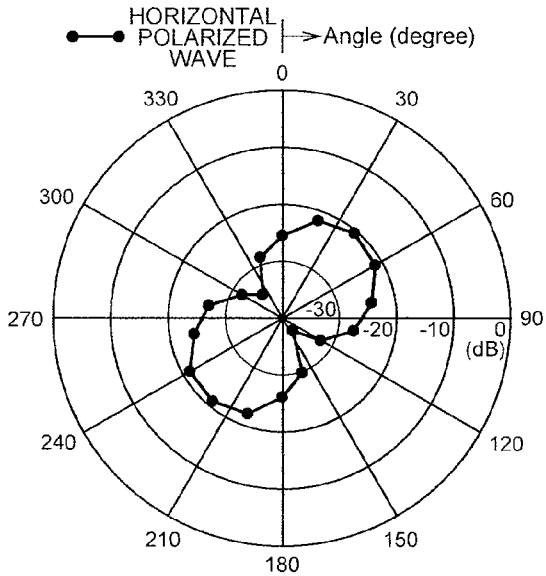
FIG. 3B shows gain characteristics when the ground of the antenna unit and the metal casing are connected.

The gain characteristics change unit 12 interrupts continuity between the ground GND of the antenna unit 10 and a conductive portion according to a command from the control unit 14 to change the gain characteristics of the antenna 11. In the first embodiment, the gain characteristics change unit 12 interrupts continuity between the ground GND of the antenna unit 10 and the metal casing 18 by a mechanical switch 13 having one contact for interrupting the continuity between these parts. FIGS. 3A and 3B show the gain characteristics of the antenna 11. FIG. 3A illustrates the condition of non-continuity between the GND of the antenna unit 10 and the metal casing 18, that is, the gain characteristics when the GND of the antenna unit 10 corresponds to the GND portion of the substrate. FIG. 3B illustrates the condition of continuity between the GND of the antenna unit 10 and the metal casing 18, that is, the gain characteristics when the GND of the antenna1 unit 10 corresponds to the GND portion of the substrate and the metal casing 18. As shown in these figures, the presence of metal material in the vicinity of the antenna 11 lowers the characteristics of the antenna 11. Thus, the gain characteristics of the antenna 11 under the condition of continuity between the GND of the antenna unit 10 and the metal casing 18 are approximately 10 dB lower than those under the condition of non-continuity between both. When the gain characteristics change unit 12 is constituted by an active element, the possibility of electrostatic breakage considerably lowers due to the position of the gain characteristics change unit 12 not located immediately below the antenna.

According to the first embodiment, the two types of gain characteristics are switched by interruption of the continuity between the GND of the antenna unit 10 and the metal casing 18. However, three or more types of gain characteristics may be switched by changing plural switches having different continuity positions for one metal component such as the metal casing 18, or by changing plural switches each of which is provided for the corresponding one of plural metal components. Alternatively, the gain characteristics may be varied by changing impedance of the antenna 11 through interruption between the antenna 11 and a not-shown electronic component such as coil and capacitor. Also, a known automatic gain control (AGC) for varying gains of an amplifier according to electric field intensity may be used in combination.

Returning to FIG. 1, the receiving unit 20 includes an RF (radio frequency) processing unit 40, a baseband processing unit 24, a time information extracting unit 26, and a data acquisition judging unit 27. The receiving unit 20 receives time information contained in a communication signal received by the antenna unit 10 according to a command from the control unit 14. The RF processing unit 40 has a low-noise amplifier 42, a frequency converting section 44, an IF (intermediate frequency) band pass filter 48, and a local generation signal producing section 46. A communication signal inputted to the antenna unit 10 is amplified by the low-noise amplifier 42, and mixed with a local generation signal produced by the local generation signal producing section 46 at the frequency converting section 44. As a result, a time signal contained in the communication signal is converted into an IF signal having frequency corresponding to the difference between the frequency of the time signal and the frequency of the local generation signal (local generation frequency). Then, the converted signal is filtered by the IF band pass filter 48 and outputted therefrom.

The baseband processing unit 24 has a synchronizing section 28 and a data acquiring section 30. The baseband processing unit 24 converts the IF signal into a digital signal by A/D conversion. Then, the base band processing unit 24 applies demodulating process of CDMA to two digital signals (I signal and Q signal) having orthogonal phases to decode data containing time information. The function of the baseband processing unit 24 is now described in detail. The synchronizing section 28 obtains synchronous timing for achieving synchronization with the base station from a pilot channel signal contained in a high frequency signal. The data acquiring section 30 demodulates a sink channel signal from the digital signal based on the obtained synchronous timing and decodes the demodulated sink channel signal to extract data from the sink channel signal. The data acquiring section 30 has a reverse diffusion part 32, a modulation judgment part 34, and a decode part 36.

In the first embodiment, the I signal and the Q signal are inputted to each of the synchronizing section 28 and the reverse diffusion part 32. The synchronizing section 28 performs correlation calculation with short period PN code for identifying the baseband signal and the base station, and notifies the reverse diffusion part 32 of the calculated correlation peak timing. The reverse diffusion part 32 multiplies the I signal and the Q signal by the short period PN code based on the notified timing synchronization. Also, the reverse diffusion part 32 demodulates the pilot channel signal by multiplying No. 0 in Walsh code as code for channelization and integrating the result, and demodulates the sink channel signal by multiplying No. 32 in Walsh code and integrating the result. The pilot channel signal is used to achieve synchronization between the base station and the receiving device, and the sink channel signal is used to supply information such as time and system setting from the base station.

The modulation judging part 34 excludes phase rotation based on the pilot channel signal, and judges binary phase shift keying (BPSK) data contained in the sink channel signal. The decoding part 36 returns the order of the data changed by repeater and interleaver during data transmission from the base station to the original order by de-interleaver and de-repeater. The decoding part 36 also restores the transmitted 128-bit unit data to 32-bit unit data by applying process opposite to convolution coding process performed at the time of transmission by using a not-shown error correcting section. The sink channel signal contained in the data decoded by the data acquiring section 30 is transmitted to the time information extracting unit 26.

The data acquisition judging unit 27 supplies information about failure of data acquisition to the control unit 14 when the sink channel signal is not decoded in the normal condition by the data acquiring section 30. When the sink channel signal is decoded in the normal condition, the time information extracting unit 26 extracts information about time from the data contained in the decoded sink channel signal. The extracted information about time is transmitted to the time information output unit 16.

The time information output unit 16 outputs the information about time to other devices for display or printing of the information. According to the radio clock 1 in the first embodiment, the information about time is transmitted to the movement 17 to correct the display time based on the standard time. The movement 17 is a driving unit of the clock of either digital clock type or analog clock type. The specific technique for correcting the display time of the movement 17 according to the acquired time information is not included in the scope of the invention, and thus is not explained herein (see JP-A-2004-301712 for reference of the technologies in this field, for example).

The control unit 14 commands the gain characteristics change unit 12 to interrupt continuity between the ground GND of the antenna unit 10 and the metal casing 18, and commands the receiving unit 20 to acquire time information. When information about failure of decoding of the sink channel signal is transmitted from the data acquisition judging unit 27, the control unit 14 commands the gain characteristics change unit 12 to make continuity between the ground GND and the metal casing 18 and commands the receiving unit 20 to obtain time information from the communication signal inputted to the antenna 11 whose gain characteristics have been changed by this operation.

The respective function units discussed above may be provided by using a not-shown electric circuit. The electric circuit including CPU (central processing unit), RAM (random access memory), ROM (read only memory), memory card, and other components may be provided by hardware and software cooperating with each other. At least a part of the function units may be mounted on an integrated circuit.

Figure 4:
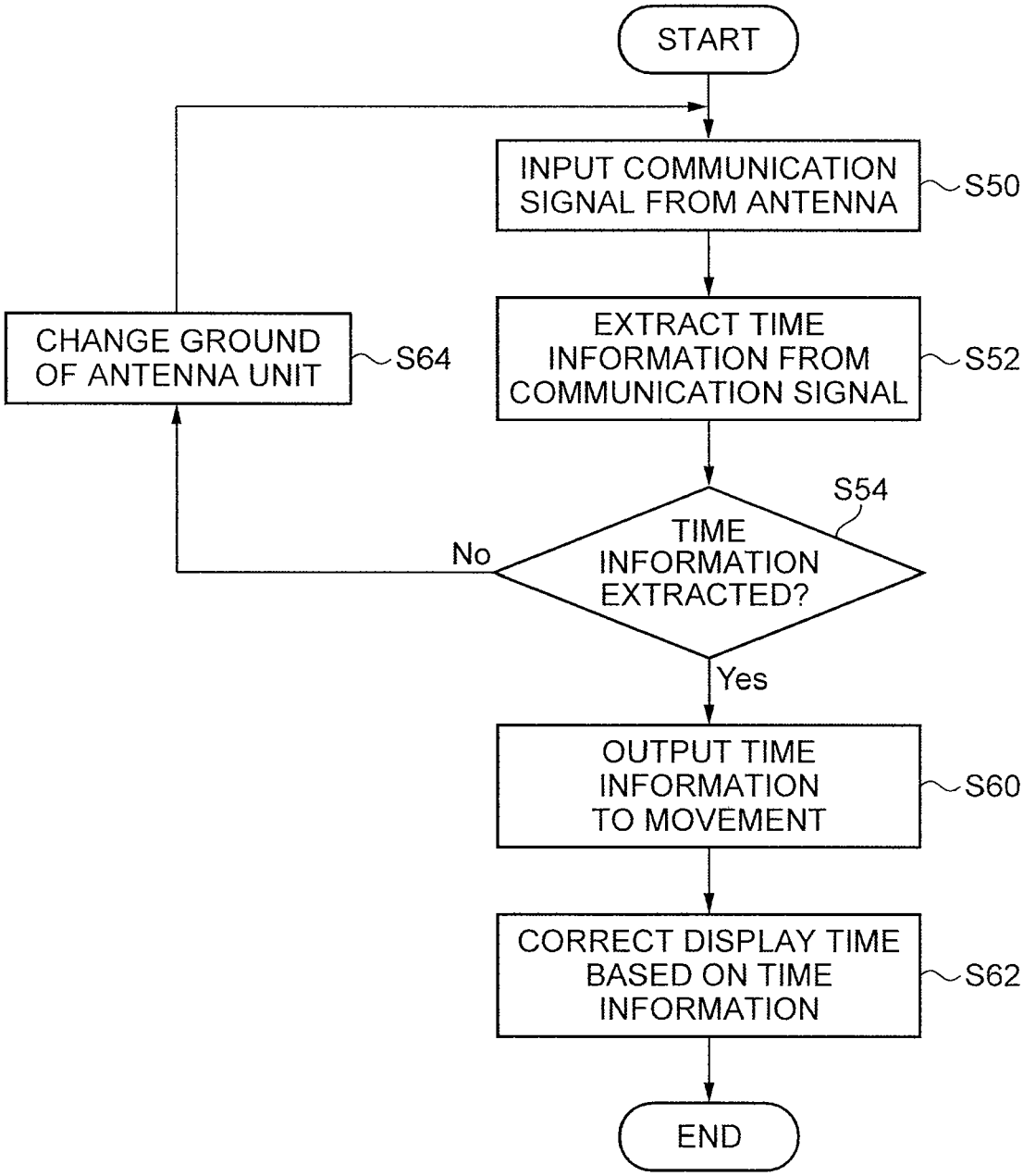
FIG. 4 is a flowchart showing a process performed by the radio clock for receiving a communication signal, extracting time information, and correcting display time.

The flow of processing performed by the radio clock 1 for receiving a communication signal, extracting time information, and correcting the display time is now described with reference to FIG. 4. At the start of this processing, a communication signal is initially inputted via the antenna 11 under the condition of non-continuity between the ground GND of the antenna unit 10 and the metal casing 18 (high gain condition) (step S50). Then, the receiving unit 20 extracts time information from the communication signal received via the antenna 11 (step S52).

Then, it is judged whether the receiving unit 20 has extracted time information from the communication signal (step S54). When time information has been extracted from the communication signal (Yes in step S54), the extracted time information is outputted to the movement 17 (step S60). The movement 17 corrects the display time based on the time information (step S62), and the series of the processing ends.

When time information is not extracted from the communication signal (No in step S54), the gain characteristics change unit 12 changes the continuity condition between the ground GND of the antenna unit 10 and the metal casing 18 (step S64). After the continuity condition between the ground GND and the metal casing 18 is changed, the gain characteristics of the antenna 11 shift to low condition (low gain condition). Then, the flow returns to the initial step (step S50) to receive a communication signal by the antenna 11 having gain characteristics different from those in the previous process.

As well known, electric field intensity of radio waves is extremely high in the vicinity of the base station which transmits radio waves containing time signals. Thus, distortion is caused due to saturation of the amplifier such as the low-noise amplifier 42, and the receiving capability lowers. However, the saturation of the amplifier can be prevented by decreasing gain characteristics of the antenna 11, and the receiving capability can be enhanced. In the first embodiment, time required for one reception is approximately 300 milliseconds. Thus, the user of the radio clock 1 does not feel incongruous even when he or she receives a communication signal again to obtain time information. When selection from three or more types of gain characteristics is allowed, these gain characteristics may be sequentially switched before returning to the initial step (step S50).

It is also possible to shift the gain state of the antenna 11 to high gain state when time information cannot be extracted from the communication signal under the low gain state of the antenna 11 at the start of processing, i.e., in the initial condition. This method is appropriate under the environment where electric field intensity of radio waves is low and no saturation of the amplifier is caused. In this case, reception sensitivity improves by increasing the gain condition of the antenna 11 to high gain state.

According to the first embodiment, the following advantages are offered.

(1) When time information cannot be extracted from a received communication signal, the gain characteristics of the antenna 11 are changed and a communication signal is again received for obtaining time information. Thus, the possibility of acquiring time information from the communication signal received again increases.

(2) The time required for receiving the communication signal again and acquiring time information after changing the gain characteristics of the antenna 11 is as short as 300 milliseconds. Thus, the user of the radio clock 1 can obtain time information without feeling incongruous.

Second Embodiment

Figure 5:
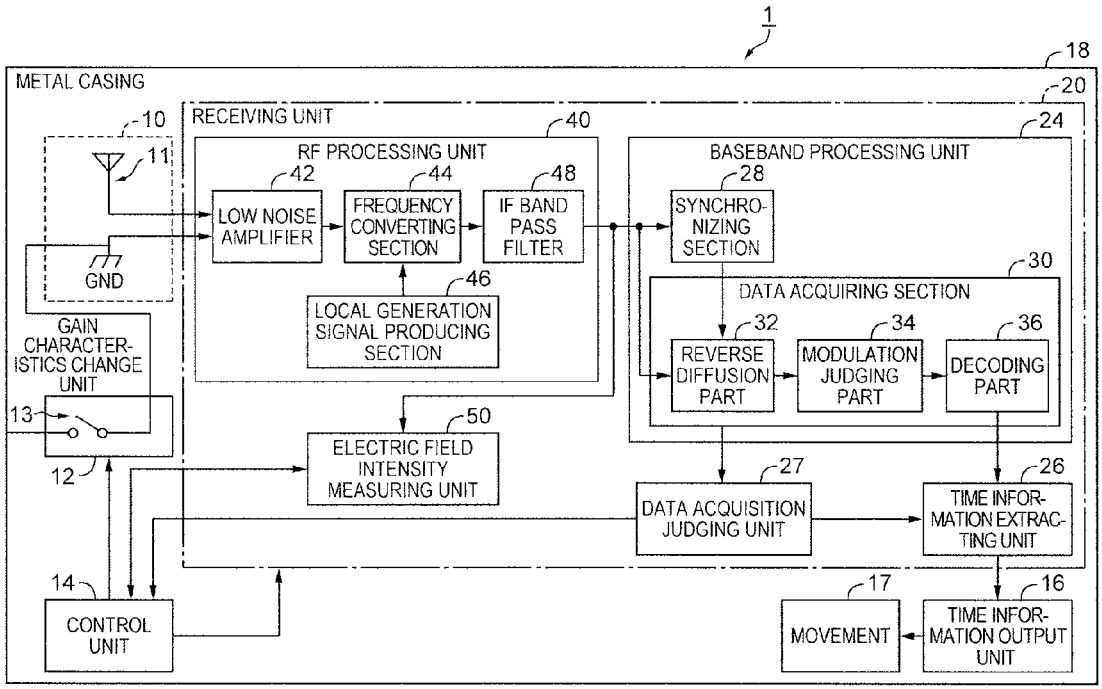
FIG. 5 is a block diagram showing a structure of a radio clock according to a second embodiment.

A second embodiment is now described with reference to FIG. 5. In the following description, similar reference numbers are given to parts similar to those discussed above, and the same explanation is not repeated. According to the first embodiment, the control unit 14 controls interruption of continuity between the ground GND of the antenna unit 10 and the metal casing 18 when time information cannot be extracted from a communication signal. In the second embodiment, an electric field intensity measuring unit 50 for measuring electric field intensity is disposed behind the RF processing unit 40 as shown in the block diagram in FIG. 5. The electric field intensity measuring unit 50 measures electric field intensity in response to a command from the control unit 14, and the information about the measured electric field intensity is transmitted to the control unit 14. When time information cannot be extracted from the communication signal inputted to the antenna 11, the control unit 14 commands the electric field intensity measuring unit 50 to measure electric field intensity. When the measured electric field intensity is higher than a predetermined reference value, the control unit 14 judges that the amplifier is saturated by the excessive electric field intensity of the radio waves. Then, the control unit 14 commands the gain characteristic change unit 12 to make continuity between the ground GND of the antenna unit 10 and the metal casing 18 to decrease the gain characteristics of the antenna 11, and commands the receiving unit 20 to receive a communication signal for obtaining time information.

According to the second embodiment, the following advantage is offered as well as the advantages (1) and (2) provided in the first embodiment.

(3) When the electric field intensity measured by the electric field intensity measuring unit 50 is higher than the predetermined reference value, the gain characteristics of the antenna 11 are decreased. As a result, saturation of the amplifier is reduced, and therefore distortion of the receiving signal is removed. Accordingly, the receiving capability improves.

Third Embodiment

Figure 6:
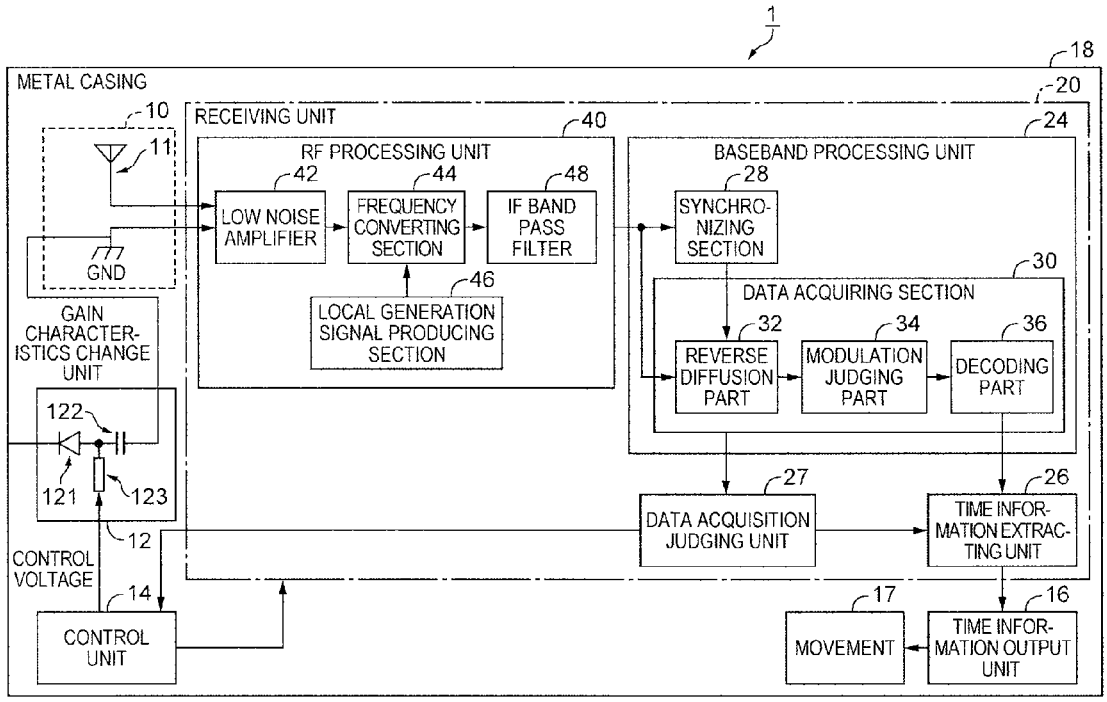
FIG. 6 is a block diagram showing a structure of a radio clock according to a third embodiment.

A third embodiment is now described with reference to FIG. 6. FIG. 6 is a block diagram showing a structure of the radio clock 1 in the third embodiment. According to the structures in the first and second embodiments, the gain characteristics change unit 12 interrupts continuity between the ground GND of the antenna unit 10 and the metal casing 18 via the switch 13 as a mechanical contact to change gain characteristics. In the third embodiment, however, the continuity is interrupted by an electrical switch. More specifically, the gain characteristics change unit 12 has a diode 121, a capacitor 122, and a resistance 123, and controls continuity between the ground GND of the antenna unit 10 and the metal casing 18 by using direct current control voltage and the diode 121. The continuity may be interrupted by a relay in place of the diode 121.

According to the third embodiment, the following advantage is offered as well as the advantages (1), (2) and (3) provided in the first and second embodiments.

(4) The continuity between the ground GND of the antenna unit 10 and the metal casing 18 is interrupted by the electrical switch. Thus, the continuity can be easily controlled from the outside.

While the first through third embodiments have been described with reference to the drawings, specific structures according to the invention are not limited to those shown in the respective embodiments. It is therefore intended that design changes and modifications may be made without departing from the scope of the invention. For example, the receiving device of the invention is not limited to that contained in the radio clock 1, but may be included in an information processing terminal or the like having time function for correcting time based on information transmitted on radio waves.

What is claimed is:

1. A receiving device, comprising:

an antenna configured to receive a communication signal containing time information, the antenna comprising a ground terminal;

a gain characteristics change unit configured to make or interrupt continuity between the ground terminal and a conductive portion of the receiving device so as to vary a gain characteristic of the antenna;

a receiving unit coupled to the antenna and configured to obtain the time information from the communication signal; and a control unit coupled to the receiving unit and to the gain characteristics change unit, the control unit configured to determine when the time information is obtained, and to cause the gain characteristics change unit to vary the gain characteristic of the antenna if the time information is not obtained.

2. The receiving device according to claim 1, wherein the gain characteristics change unit comprises a switch configured to interrupt continuity between the ground terminal and the conductive portion in a non-conductive condition and to make continuity between the ground terminal and the conductive portion in a conductive condition, and wherein the antenna has a higher gain characteristic when the switch is under the non-conductive condition than when the switch is under the conductive condition.

3. The receiving device according to claim 1, further comprising:

an electric field intensity measuring unit configured to measure an electric field intensity of the communication signal, and wherein the control unit causes the gain characteristics change unit to vary the gain characteristic of the antenna based on the electric field intensity of the communication signal.

4. The receiving device according to claim 3, wherein the control unit causes the gain characteristics change unit to make continuity between the ground terminal and the conductive portion when the electric field intensity of the communication signal exceeds a predetermined value.

5. The receiving device according to claim 1, wherein the gain characteristics change unit comprises a diode, and wherein the diode makes or interrupts continuity in response to a control signal from the control unit.

6. The receiving device according to claim 2, wherein the conductive condition includes a first position of continuity having a first gain characteristic and a second position of continuity having a second gain characteristic.

7. A radio clock, comprising the receiving device according to claim 1.

8. The radio clock according to claim 7, wherein the conductive portion comprises a metal case of the receiver.

9. A receiving method, comprising:

receiving a communication signal containing time information at an antenna;

processing the communication signal a first time to obtain the time information;

determining when the time information is obtained from the communication signal;

changing a gain characteristic of the antenna by adjusting continuity between a first ground reference and a second ground reference of the antenna and processing the communication signal a second time if the time information is not obtained from the communication signal.

10. A self-adjusting portable radio clock, comprising:

a metal casing;

an antenna disposed within the metal casing and configured to receive a communication signal containing time information;

a gain control unit configured to make continuity between the antenna and the metal casing in a first state and to interrupt continuity between the antenna and the metal casing in a second state so as to vary a gain characteristic of the antenna; and a processor configured to obtain the time information from the communication signal and to output a time correction signal, wherein the processor causes the gain control unit to change states when the time information is not obtained and the processor is configured to obtain the time information from the communication signal subsequent to changing states; and a movement configured to adjust a displayed time of the radio clock based on the time correction signal.

11. The radio clock of claim 10, wherein the first state comprises at least first and second continuity positions, each continuity position corresponding to a different gain characteristic of the antenna.

12. The radio clock of claim 10, wherein the communication signal is a CDMA communication signal and the processor is configured to obtain the time information from the CDMA communication signal.

13. The radio clock of claim 10, wherein the gain control unit comprises a switch configured to control a mechanical connection between the antenna and the metal casing.

14. The radio clock of claim 10, wherein the switch includes a relay.

15. The radio clock of claim 10, wherein the gain control unit comprises a diode configured to control an electrical connection between the antenna and the metal casing.

16. The radio clock of claim 10, further comprising a electric field intensity measuring unit coupled to the antenna and to the processor, the electric field intensity measuring unit configured to measure an electric field intensity of the communication signal.

17. The radio clock of claim 15, wherein the processor causes the gain control unit to change states based on the electric field intensity of the communication signal.

18. The radio clock of claim 15, wherein the processor causes the gain control unit to make continuity between the antenna and the metal casing when the electric field intensity of the communication signal exceeds a predetermined value.

19. The radio clock of claim 10, wherein the gain control unit varies the gain characteristic of the antenna absent active attenuation of the communication signal by other elements of the radio clock.

20. The radio clock of claim 10, wherein radio clock is adapted and configured to be worn as a wrist watch.

* * * * *